US006236299B1

(12) United States Patent
Yu

(10) Patent No.: US 6,236,299 B1
(45) Date of Patent: May 22, 2001

(54) AUTO TRIPPING KEY SWITCH

(76) Inventor: Tsung-Mou Yu, No. 4, Alley 2, Lane 23, Sec. 3, Pa-Te Road, Pan-Chiao City, Taipei (TW)

( * ) Notice: Subject to any disclaimer, the term of this patent is extended or adjusted under 35 U.S.C. 154(b) by 0 days.

(21) Appl. No.: 09/360,660

(22) Filed: Jul. 26, 1999

(30) Foreign Application Priority Data

Jan. 28, 1999 (TW) ..... 88201412

(51) Int. Cl.[7] ..... H01H 27/00; H01H 27/06; H01H 19/58

(52) U.S. Cl. ..... 337/50; 337/85; 337/333; 337/334; 337/362; 337/351; 200/43.11; 200/21; 200/179; 200/273

(58) Field of Search ..... 337/334, 36, 37, 337/50, 85, 86, 112, 113, 333–337, 362, 351, 379, 380; 200/43.01–43.22, 21, 24, 179, 237, 273, 303, 564, DIG. 39

(56) References Cited

U.S. PATENT DOCUMENTS

| | | | | |
|---|---|---|---|---|
| 3,630,306 | * | 12/1971 | Shur et al. | 180/114 |
| 3,650,131 | * | 3/1972 | Eichenauer | 70/252 |
| 3,660,624 | * | 5/1972 | Bell | 200/44 |
| 3,819,887 | * | 6/1974 | Lipschutz | 200/44 |
| 3,826,116 | * | 7/1974 | Messera et al. | 70/388 |
| 3,912,886 | * | 10/1975 | Allen et al. | 200/11 A |
| 4,099,395 | * | 7/1978 | Garza | 70/360 |
| 4,198,552 | * | 4/1980 | Tahara | 200/44 |
| 4,227,056 | * | 10/1980 | Johnston et al. | 200/44 |
| 4,400,954 | * | 8/1983 | Nakamoto et al. | 70/186 |
| 4,419,546 | * | 12/1983 | Arthur | 200/11 G |
| 4,558,193 | * | 12/1985 | Test | 200/43.05 |
| 4,623,763 | * | 11/1986 | Krause | 200/11 K |
| 4,639,562 | * | 1/1987 | Fredrickson | 200/43.08 |
| 4,748,297 | * | 5/1988 | Sorenson et al. | 200/11 J |
| 4,803,314 | * | 2/1989 | Sorenson et al. | 200/11 J |
| 5,235,832 | * | 8/1993 | Lux et al. | 70/368 |
| 5,252,791 | * | 10/1993 | Williams | 200/11 C |
| 5,669,489 | * | 9/1997 | Von Ende | 200/570 |
| 5,977,498 | * | 11/1999 | Levine | 200/302.1 |
| 6,040,535 | * | 3/2000 | Thalhammer | 200/43.08 |
| 6,122,944 | * | 9/2000 | Chandra et al. | 70/388 |

FOREIGN PATENT DOCUMENTS

| | | | | |
|---|---|---|---|---|
| 3204020 A1 | * | 8/1983 | (DE) | 200/43.08 |
| 8175330 | * | 7/1996 | (JP) | B60R/25/04 |

* cited by examiner

*Primary Examiner*—Leo P. Picard
*Assistant Examiner*—Anatoly Vortman
(74) *Attorney, Agent, or Firm*—Senniger, Powers, Leavitt & Roedel

(57) ABSTRACT

This invention is related to an auto tripping key switch, comprising a switch housing being formed with at least one guide groove and one slideway at an inner side thereof; a first contact plate and a second contact plate that are fastened to the switch housing, the first contact plate being provided with a first contact and the second contact being connected to a deformable bi-metallic strip provided with a second contact that opposes to and is spaced from the first contact at an appropriate distance. This invention further comprises a key that is provided with a first protrusion engaging the guide groove within the switch housing such that the key is only slidable along the guide groove, the key having an inner serrate edge; and a cylindrical insulative housing that is slidable in the switch housing and has an end being formed with a serrate edge matching the serrate edge of the key so as to subject rotation of the cylindrical insulative housing when the key is being pushed. The cylindrical insulative housing is provided with at least a second protrusion having an end being formed with at least a slit. The slit has a closed end that is formed with a beveled face. This invention may further comprise a resilient member that biases the cylindrical insulative housing towards the key in relation of the switch housing. The bi-metallic strip is resiliently pushed towards the cylindrical insulative housing. While encountering current overload, deformation of the bi-metallic strip of the key switch of this invention, as a result of temperature increase, will automatically trip the key switch to form a closed circuit so as to ensure electrical safety.

10 Claims, 7 Drawing Sheets

AUTO TRIPPING KEY SWITCH

FIELD OF INVENTION

This invention is related to an auto tripping key switch, in particular to a key switch that can be automatically tripped to form a closed circuit while encountering current overload so as to ensure electrical safety.

BACKGROUND OF INVENTION

FIG. 1 illustrates an exploded view of a conventional key switch 1, comprising an upper housing 10, a lower housing 11, a hollow cylindrical housing 12 that substantially extends upwards from a center of the upper housing 10, the cylindrical housing 12 being formed at an inner face thereof with four linear guide grooves 13 that are spaced from each other in 90 degrees apart, the guiding grooves 13 being formed with a beveled step face 14 therebetween, the step faces 14 each having a top of a relatively greater thickness and projecting towards an inner side of the hollow cylindrical housing 12. The switch 1 further comprises a cylindrical key 15 being formed at a bottom thereof with four pentagonal protrusions 16 engaging and moving along the linear guide grooves 13, the pentagonal protrusions 16 each having a tip 22 facing downwards and a bottom edge 17 located between the protrusions 16 and extending upwards along the tips 22 to form inverse-V configurations such that the entire bottom edge 17 of the key 15 forms a serrate periphery. The key 15 may engage an engaging unit 18 therein; the engaging unit 18 is formed with a square aperture 19 therein and includes four triangular protrusions 20 at the bottom thereof. The triangular protrusions 20 form an outer diameter that is in-between the inner diameters formed by opposing ends of the step faces 14 in the hollow cylindrical housing 12. The triangular protrusions 20 each has a beveled face 21 that adapts to the tips 22 of the pentagonal protrusions 16 located at the bottom of the key 15.

The engaging unit 18 is further provided therebeneath with a follower rotary body 23 having a square column 24 at an upper portion that adapts 5 to be inserted into the square aperture 19 of the engaging unit 18 such that the follower rotary body 23 may be driven to rotate by the engaging unit 18. The follower rotary body 23 has a bottom being formed by a disc 25, above that a spring 26 is provided engaging around the square column 24. The spring 26 has an upper end that engages a lower edge of the engaging unit 18. The disc 25 is provided with two opposing raised faces 27 at the outer bottom edge of the disc 25, the raised faces 27 each having a thickness that gradually increases while approaching towards a periphery of the disc 25. The disc 25 is further provided with two separate semi-circular supports 28 at the center thereof. The semi-circular supports 28 each have an arcuate inner edge and are provided with a Z-like metallic strip 29 therebetween, as shown in FIG. 1. The lower housing 11 of the conventional switch 1 is formed with a circular recess 2 for receiving the disc 25 located at the bottom of the follower rotary body 23. The recess 2 is formed with an emboss 3 at the center thereof for engaging the two semi-circular supports 28 located at the bottom of the disc 25. The lower housing 11 is further provided with two metallic conductive contacts 4 each having an end 5 that forms a leaf extending towards the circular recess 2 and elevating slightly upwards. The two conductive contacts 4 are each provided with a screw 6 thereon for connecting electrical leads (not shown.)

FIGS. 2A to 2C are cross-sectional views of the conventional key switch 1 illustrating internal structure of the key switch 1 and the switch transition from open to closed circuits. FIG. 2A illustrates the switch 1 in its state of closed circuit. Under the state of closed circuit, the ends 5 of the two contacts 4 are in contact with the raised faces 27 located at the bottom of the disc 25. The follower rotary body 23 made of insulative material subjects the switch 1 to be in the state of closed circuit. A user may push the key 15 to switch the switch 1 from the state of closed circuit to the state of open circuit. At this time, the pentagonal protrusions 15 located at the bottom of the key 15 still overlay the triangular protrusions 20 located at the bottom of the engaging unit 18 as that shown in FIG. 2A, and engage the linear guide grooves 13 such that both the key 15 and engaging unit 18 are movable along a perpendicular direction. When the engaging unit 18 moves downward to outside of the step faces 14 of the triangular protrusions 20 located at the bottom of the engaging unit 18, the engaging unit 18 is no longer retrained by the linear grooves 13 because the outer diameter of the triangular protrusions 20 located at the bottom of the engaging unit 18 is smaller than the inner diameter of the hollow cylindrical housing 12 beneath the step faces 14, and the engaging unit 18 is thus now rotatable. Because the spring 26 will exert an upward force on the engaging unit 18 after being compressed by the engaging unit 18, the spring 26 will subject the triangular protrusions 20 located at the bottom of the engaging unit 18 to follow the pentagonal protrusions 16 and serrate edges 17 for upward and rotary motions. While viewing from top, the engaging unit 18 rotates a minute angle in a counterclockwise direction subjecting the triangular protrusions 20 to engage the inverse-V serrate edges 17 of the key 15, such as that shown in FIG. 2B, and driving the follower rotary body 23 to rotate simultaneously.

When the user releases the key 15, the thrust of the spring 26 subjects upward movement of the engaging unit 18 such that the triangular protrusions 20 of the engaging unit 18 urge against the lower edges of the beveled step faces 14 and the engaging unit 18 continues to trace along the lower edges of the beveled step faces 14 in upward and counterclockwise rotary motions. The engaging unit 18 further drives simultaneous rotation of the follower rotary body 23 until the triangular protrusions 18 of the engaging unit 18 re-enter the linear grooves 13. At this time, the pentagonal protrusions 16 located at the bottom of the key 15 again overlay the triangular protrusions 20 located at the bottom of the engaging unit 18; the key 15 and the engaging 18 are further pushed upwards by the spring 26 until the pentagonal protrusions 16 of the key 15 urge against a lip 7 of the hollow cylindrical housing 12, as shown in FIG. 2C. At this time, the follower rotary body 23 is exactly 90 degrees away from the upper and lower housings 10, 11 of the switch 1, and opposing sides of the Z-like metallic strip 29 on the bottom of the disc 25 are in contact with the two ends 5 of the conductive contacts 4, respectively, such that the two contacts 4 are electrically connected by means of the ends 5 and the Z-like metallic strip 29 to enable open circuit of the switch 1.

The user may push and release the key 15 again such that the is engaging unit 18 and the follower rotary body 23 may rotate for 90 degrees in a similar manner to cause the ends 5 of the two conductive contacts 4 to be in contact with the raised faces 27 located at the bottom of the disc 25, so as to switch the switch 1 from the state of open circuit to the state of closed circuit, such as that shown in FIG. 2A.

However, such a conventional construction is of a passive switch type, which relies on pushing motions of the user to switch between the open circuit and the closed circuit and thus fails to provide auto switch features. Therefore, when the switch encounters current overload under the state of open circuit, it is liable to cause electrical sparks and result in safety hazards.

SUMMARY OF INVENTION

It is a primary object of this invention to overcome defects of conventional art and to provide an auto tripping key switch, the switch comprising a switch housing being formed with at least one guide groove and one slideway at an inner side thereof; a first contact plate and a second contact plate that are fastened to the switch housing, the first contact plate being provided with a first contact and the second contact being connected to a deformable bimetallic strip provided with a second contact that opposes to and is spaced from first contact at an appropriate distance. This invention further comprises a key that is provided with a first protrusion engaging the guide groove within the switch housing such that the key is only slidable along the guide groove, wherein the key features an inner serrate edge; and a cylindrical insulative housing that is slidable in the switch housing and has an end being formed with a serrate edge matching the serrate edge of the key so as to cause rotation of the cylindrical insulative housing when the key is being pushed. The cylindrical insulative housing is provided with at least a second protrusion having an end being formed with at least a slit. The slit has a closed end that is formed with a beveled face. This invention may further comprise a resilient member that biases the cylindrical insulative housing towards the key in relation of the switch housing. The bi-metallic strip resiliently urges towards the cylindrical insulative housing.

When the key switch of this invention is at a first position, that is, where the second protrusion is restrained by the slideway such that the cylindrical insulative housing is maintained in a static state, the second contact urges against the cylindrical insulative housing subjecting the key switch to be in the state of a closed circuit. When the key switch of this invention is at a second position due to cooperation between the key and cylindrical insulative housing, because the bimetallic strip resiliently urges against the cylindrical insulative housing, the second contact engages the slit of the cylindrical insulative housing and is in contact with the first contact subjecting the key switch to be in the state of an open circuit.

The bimetallic strip as used in this invention is made by joining two or more than two metallic sheets having different coefficients of thermal expansion. When current flowing through such a bimetallic strip exceeds a pre-determined value that causes thermal bending of the bi-metallic strip, such a current overload will trip the key switch.

One of the primary features of this invention resides in that, when the key switch encounters current overload at the second position of open circuit, deformation of the bimetallic strip of the key switch of this invention, as a result of temperature increase, subjects the second contact to move away from the slit. Therefore, the cylindrical insulative housing will move in an opposite direction due to thrust of the resilient member; the second protrusion will trace along the slideway causing subsequent rotation of the cylindrical insulative housing until the second protrusion is retrained by the slideway to stop the cylindrical insulative housing whereby the key switch returns to the first position of closed circuit. Therefore, current overload will automatically trip the key switch of this invention so as to form a state that is identical to that of a closed circuit. An additional pushing motion of the key, at this time, cannot cause the second contact to be in contact with the first contact to form an open circuit. Normal on/off actions can only be carried out when the bi-metallic strip naturally cools down to its normal state. Therefore, this invention can automatically trip the switch to form a closed circuit while encountering current overload so as to ensure electrical safety.

The structure and characteristics of this invention can be realized by referring to the appended drawings and explanations of the preferred embodiments.

BRIEF DESCRIPTIONS OF DRAWINGS

EXPLANATIONS OF PREFERRED EMBODIMENTS

Figure 1:
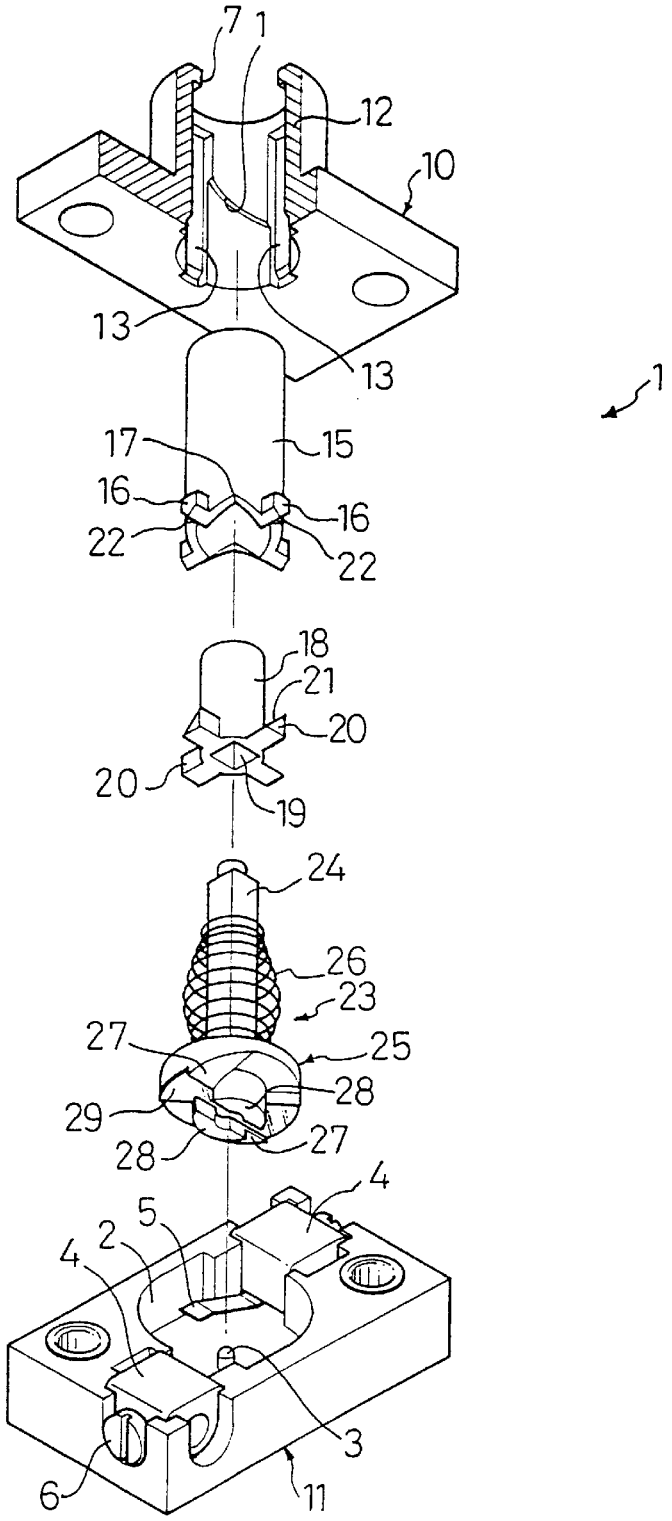
FIG.1 (Prior Art)
FIG. 1 is an exploded view of a conventional key switch.
Figure 2A:
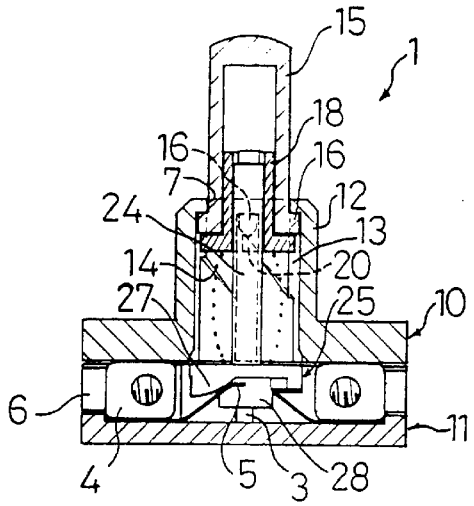
FIG.2A (Prior Art)
FIGS. 2A–2C are cross-sectional views of the conventional key switch illustrating the states of open and closed circuits.
Figure 2B:
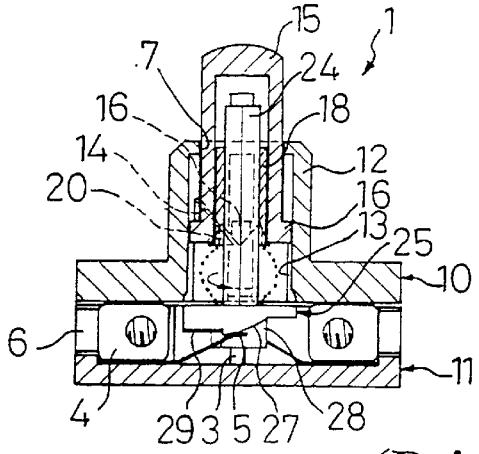
FIG.2B (Prior Art)
Figure 2C:
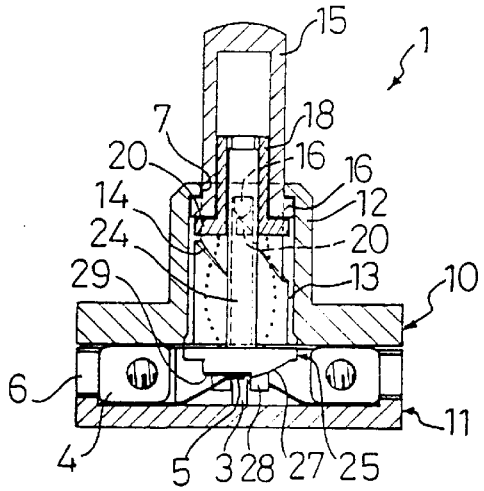
FIG.2C (Prior Art)
Figure 3:
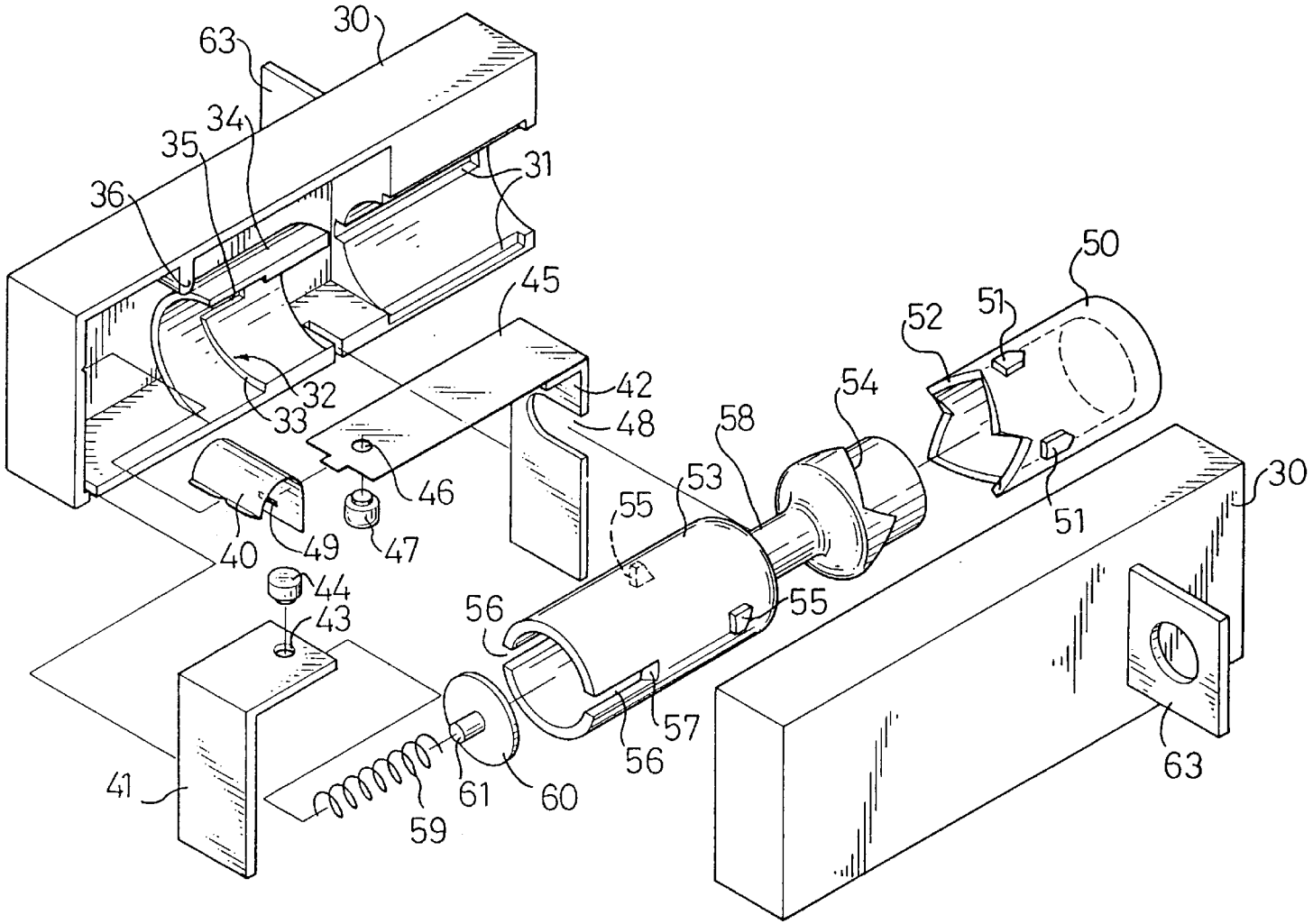
FIG. 3 is an exploded view of this invention.
Figure 4:
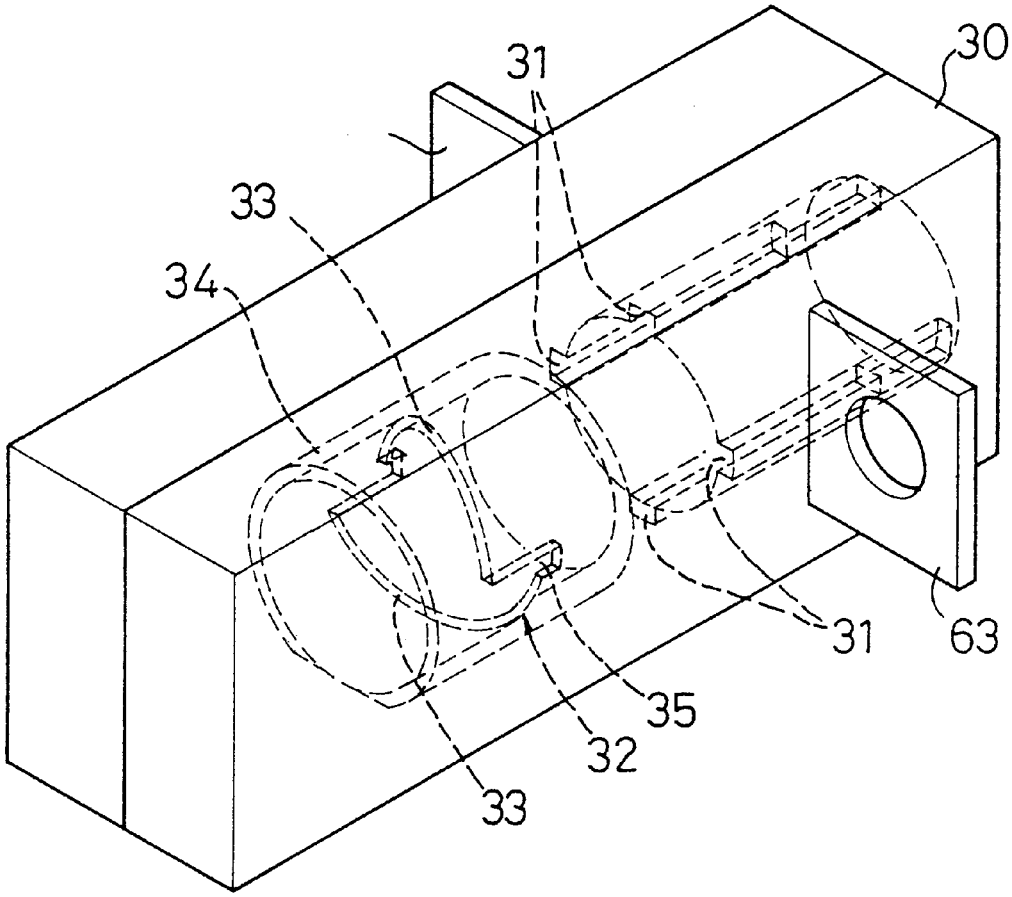
FIG. 4 is an assembled view of the key switch of this invention, illustrating internal constructions of the guide grooves and slideways.

This invention is related to an auto tripping key switch. Detailed constructions of a preferred embodiment are illustrated in FIG. 3. This invention comprises a switch housing 30 that may be separated into two parts. The housing 30 is formed at an inner side thereof with at least one guide groove 31 and one slideway 32. In this embodiment, the housing 30 is formed with four linear guide grooves 31 and the slideway 32 includes two beveled semi-circular step faces 33 provided in a cylindrical housing 34. The two semi-circular step faces 33 are provided with two recesses 35 at where the two step faces 33 meet. FIG. 4 illustrates the switch housing 30 without being assembled to other components so as to clearly show the constructions of the guide grooves 31 and the slideway 32 of this invention.

As shown in FIG. 3, this invention further comprises a first contact strip 41 and a second contact strip 42 fastened to the switch housing 30. The two contact strips 41, 42 are rectangular strips being bent and each having an end that exposes out of the switch housing 30 so as to be connected to electrical leads (not shown.) The bent part of the first contact strip 41 includes a first contact aperture 43 for connecting to the first contact 44. The bent part of the second contact strip 42 is connected to a deformable bimetallic strip 45. The bi-metallic strip 45 includes a second contact aperture 46 for connecting to a second contact 47 that opposes to and is spaced from the first contact 44 at an appropriate distance. This invention further comprises a key 50 having at least a first protrusion 51 thereon and engaging the guide grooves 31 within the switch housing 30. In this embodiment, four protrusions 51 are provided to match the number of the linear guide grooves 31 such that the key 50 is only slidable in a linear direction along the guide grooves 31 while experiencing external force. The key 50 is formed with a serrate edge 52 at an inner side thereof. The key 50 is further provided at an inner side thereof with a cylindrical insulative housing 53 having an end that is in contact with the key 50 and includes a serrate edge 54. The serrate edges 52, 54 of the key 50 and the cylindrical insulative housing 53 have an equal number of teeth. The cylindrical insulative housing 53 is provided with at least a second protrusion 55. In this embodiment, the second protrusions 55 are trapezoidal. The cylindrical insulative housing 53 is formed with two U-shaped open slits 56 at another end thereof. The slits each have a closed end that is formed with a beveled face 57. The cylindrical insulative housing 53 in this embodiment further includes a shrunken neck 58 adapting to a recess 48 formed on the second contact strip 42 such that the second contact strip 42 is engageable over the shrunken neck 58 of the cylindrical insulative housing 53.

This invention further comprises a resilient member, such as a helical spring 59 in this embodiment. The helical spring 59 includes a first end that is fastened to the switch housing 30 or to the first contact strip 41 as that of this embodiment. The cylindrical insulative housing 53 is first formed with an open end, in which a washer 60 is provided for contacting a second end of the helical spring 59. The washer 60 may be further provided with a post 61 for guiding the helical spring 59.

The bi-metallic strip 45 of this invention, after the stamping processes, is able to resiliently urge towards the cylindrical insulative housing 53. An alternate resilient body may also be implemented, such as an arcuate spring 40 of this embodiment. The arcuate spring 40 has a first end that is fastened to the switch housing 30 and a second end that is formed with a slit 49 through which the bi-metallic strip 45 inserts subjecting the bi-metallic strip 45 to exert proper force towards the cylindrical insulative housing 53.

Figure 5A:
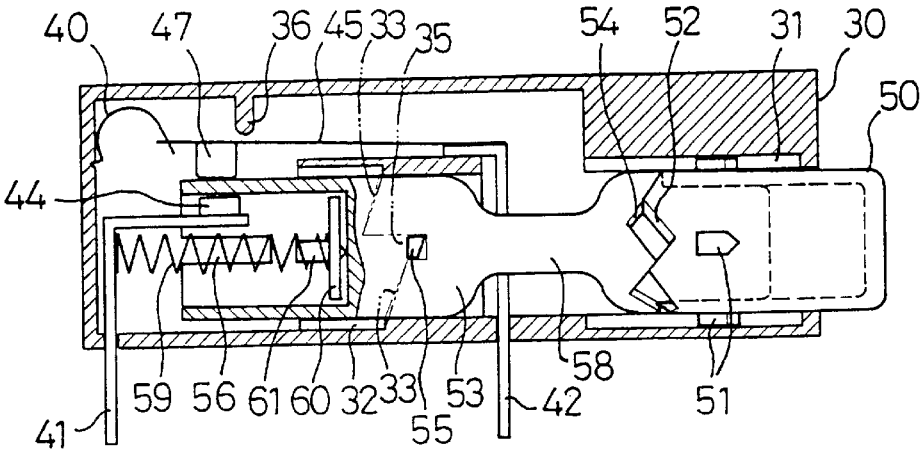
FIGS. 5A to 5G are schematic views of this invention, wherein part of the cylindrical insulative housing is cross-sected to illustrate the operations between closed circuit, open circuit, and tripping.
Figure 5B:
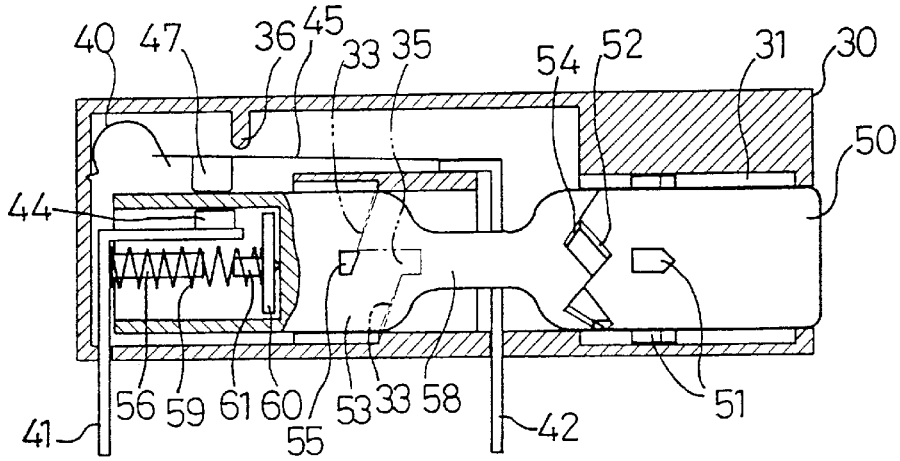
Figure 5C:
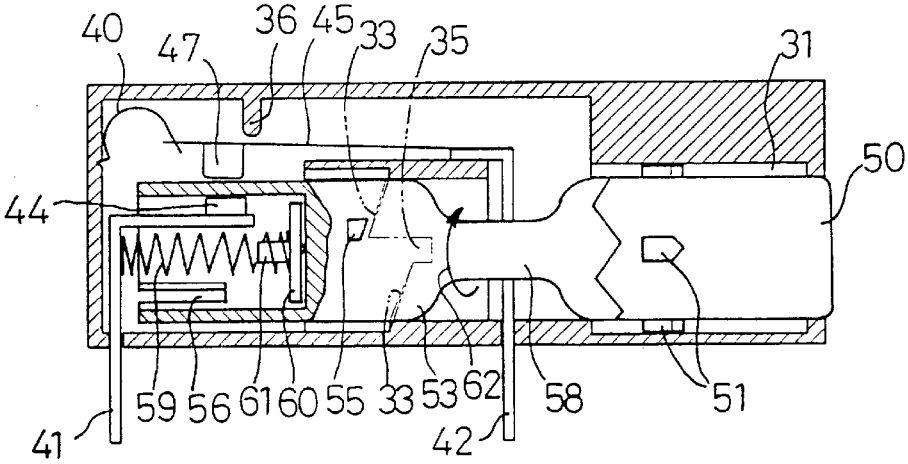
Figure 5D:
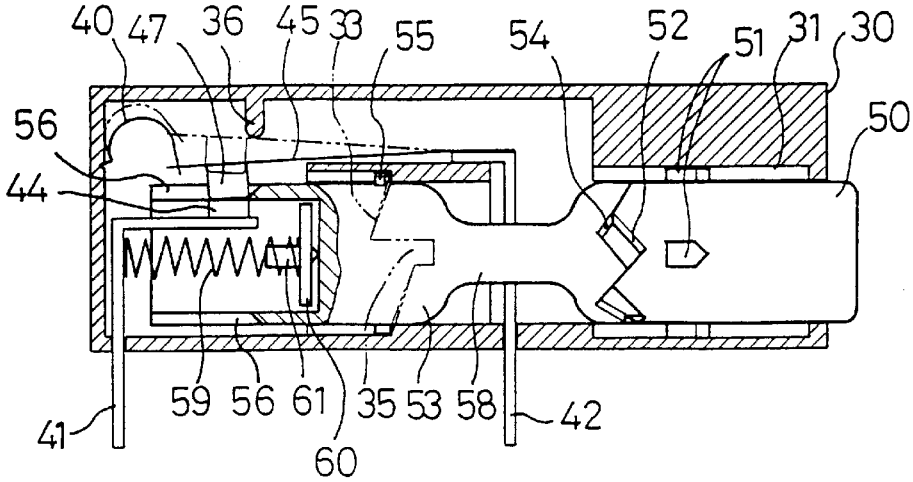

FIGS. 5A–5G are schematic views of this invention, wherein a part of the cylindrical insulative housing is cross-sectioned to illustrate the sequential operations between closed circuit, open circuit, and tripping. FIG. 5A illustrates the key switch in a first position. As shown in the figure, the second contact 47, at this time, urges against the cylindrical insulative housing 53 without contacting the first contact 44, and the switch is thus now under the state of a closed circuit. Furthermore, the second protrusions 55 of the cylindrical insulative housing 53 are restrained in the recesses 35 of the slideway 32 such that the cylindrical insulative housing 53 is maintained in a static state. To switch the key switch from the first position of closed circuit to the state of open circuit, a user may push the key 50 driving the key 50 to push the cylindrical insulative housing 53 inwards with respect to the helical spring 59. As shown in FIG. 5B, when the second protrusions 55 slide out of the semi-circular step faces 33 of the slideway 32, because the serrate edge 52 of the key 50 and the serrate edge 54 of the cylindrical insulative housing 53 initially interlace with each other, and because the helical spring 59 continues to exert force on the washer 60, the key 50 engages the cylindrical insulative housing 53 to cause the cylindrical insulative housing 53 to rotate for a minute angle in a direction indicated by an arrow 62 of FIG. 5C. Releasing the key 50 at this time, because of thrust of the helical spring 59, causes the second protrusions 55 of the cylindrical insulative housing 53 to urge against the beveled semi-circular step faces 33 subjecting subsequent rotation of the cylindrical insulative housing 53 by tracing along the semi-circular step faces 33, until the U-shaped slits 56 of the cylindrical insulative housing 53 (see FIG. 3) move to where the second contact 47 is at, as shown in FIG. 5D. Due to resilience of the bimetallic strip 45 or to the arcuate spring 40, the bi-metallic strip 45 continues to urge towards the cylindrical insulative housing 53 such that the bimetallic strip 45, at this time, bends downwards to cause the second contact 47 located thereon to engage the U-shaped open slits 56 (see FIG. 3) of the cylindrical insulative housing 53 and to prevent the cylindrical insulative housing 53 from rotation, such that the second contact 47 is now in contact with the first contact 44 subjecting the key switch to be at the second position of open circuit. It should be noted that, the serrate edge 52 of the key 50 and the serrate edge 54 of the cylindrical insulative housing 53 again interlace with each other at this time.

Figure 5E:
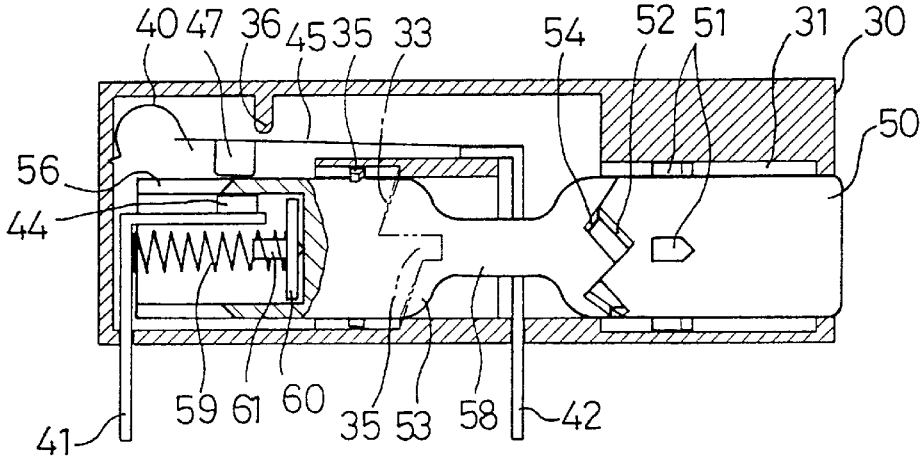
Figure 5F:
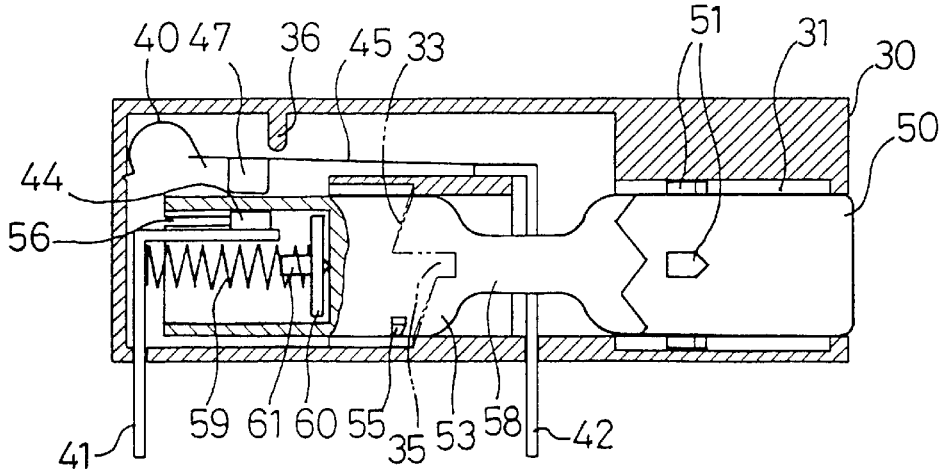
Figure 5G:
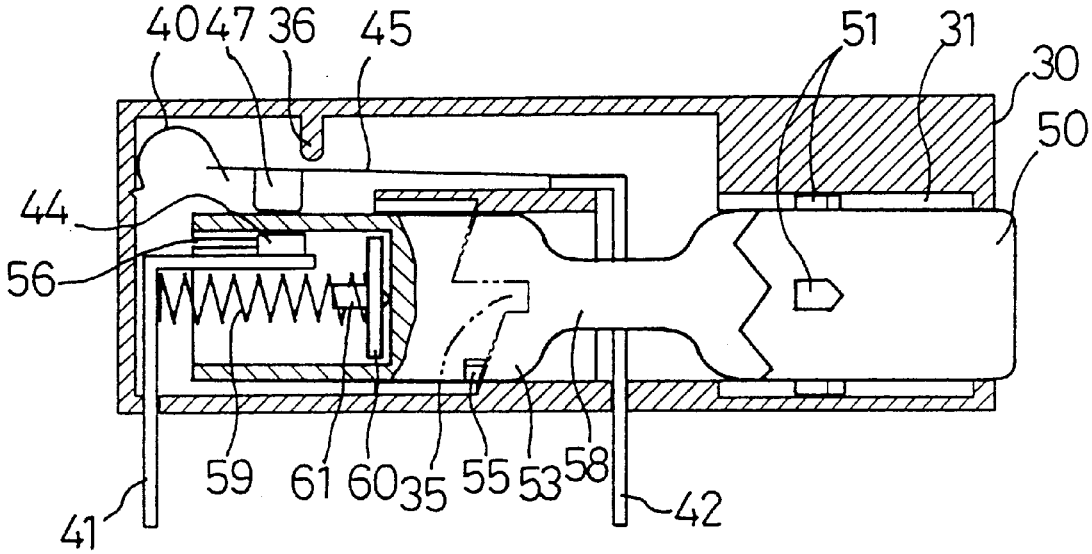

To switch the key switch from the second position of open circuit to the first position of closed circuit, the user may push the key 50 under the state shown in FIG. 5D again subjecting the key 50 to be under the state shown in FIG. 5E. Because the closed ends of the U-shaped slits 56 of the cylindrical insulative housing 53 include beveled faces 57, the beveled faces 57 may urge the second contact 47 upwards such that the second contact 47 urges against the cylindrical insulative housing 53 to form a closed circuit. Furthermore, at this time, because rotation of the cylindrical insulative housing 53 is no longer restrained by the second contact 47, cooperation between the serrate edge 52 of the key 50 and the serrate edge 54 of the cylindrical insulative housing 53, and continuous force which the helical spring 59 exerts on the washer 60 cause the cylindrical insulative housing 53 to rotate for an angle such that the key 50 and cylindrical insulative housing 53 that originally interlace with each other, engage each other, as shown in FIG. 5F. The key 50 is then released to allow the cylindrical insulative housing 53 to move outwards due to thrust of the helical spring 59 such that the second protrusions 55 on the cylindrical insulative housing 53 again urge against the beveled semi-circular step faces 33, as shown in FIG. 5E, subjecting rotation of the cylindrical insulative housing 53 by tracing along the semi-circular step faces 33. Finally, the second protrusions 55 return to the recesses 35 in the slideway 32, that is, the first position of closed circuit as shown in FIG. 5A.

One of the primary features of this invention resides in that, when the key switch encounters current overload at the second position of open circuit, deformation of the bimetallic strip 45, as a result of temperature increase, overcomes its inherent resilience due to stamping or force exerted by the arcuate spring 40 and subjects the second contact 47 to move away from the U-shaped slits 56, such as that illustrated in phantom lines of FIG. 5D. At this time, the cylindrical insulative housing 53 will move outwards due to thrust of the helical spring 59 subjecting the second protrusion 55 to urge against the beveled semi-circular step faces 33 again; the second protrusions 55 will trace along the slideway causing subsequent rotation of the cylindrical insulative housing 53 until the second protrusions 55 engage the recesses 35 of the slideway 32, that is the first position of closed circuit as that shown in FIG. 5A. Therefore, current overload will automatically trip the key switch of this invention so as to form a state that is identical to that of closed circuit. An additional pushing motion of the key 50, at this time, cannot cause the second contact 47 to be in contact with the first contact 44 forming an open circuit. Normal on/off actions can only be carried out until the bi-metallic strip 45 naturally cools down to its normal state. Therefore, this invention can automatically trip the switch to form a closed circuit while encountering current overload so as to ensure electrical safety.

The switch housing 30 of this invention can be further provided with a 30 projecting block 36 for blocking the bi-metallic strip 45 under thermo-deformation such that the bi-metallic strip 45 can automatically return to its normal state after natural cooling.

The switch housing 30 of this invention can be further provided with an ear 63 at an outer side for installing the key switch on a wall or other equipment.

This invention is related to a novel device that makes breakthrough to conventional art. Aforementioned explanations, however, are directed to the description of preferred embodiments according to this invention. Various changes and implementations can be made by those skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. An auto tripping key switch, comprising:

a switch housing being formed with at least one guide groove and one slideway at an inner side thereof;

a first contact plate and a second contact plate that are fastened to the switch housing, the first contact plate being provided with a first contact and the second contact plate being connected to a deformable bi-metallic strip provided with a second contact that opposes to and is spaced from the first contact at an appropriate distance;

a key that is provided with a first protrusion engaging the guide groove within the switch housing such that the key is only slidable along the guide groove, the key having an inner serrate edge;

a cylindrical insulative housing that is slidable in the switch housing and has an end being formed with a serrate edge matching the serrate edge of the key so as to subject rotation of the cylindrical insulative housing when the key is being pushed, the cylindrical insulative housing being provided with at least a second protrusion having an end being formed with at least a slit having a closed end that is formed with a beveled face; and a resilient member that biases the cylindrical insulative housing towards the key in relation of the switch housing;

wherein the bimetallic strip is resiliently pushed towards the cylindrical insulative housing, whereby when the key switch is at a first position, that is, where the second protrusion is restrained by the slideway such that the cylindrical insulative housing is maintained in a static state, the second contact urges against the cylindrical insulative housing subjecting the key switch to be under the state of closed circuit, and when the key switch is at a second position due to cooperation between the key and cylindrical insulative housing, because the bi-metallic strip resiliently urges against the cylindrical insulative housing, the second contact engages the slit of the cylindrical insulative housing and is in contact with the first contact subjecting the key switch to be under the state of open circuit, and when encountering current overload, deformation of the bi-metallic strip of the key switch, as a result of temperature increase, causes the second contact to move away from the slit such that the key switch automatically trips the key switch to return to the first position of closed circuit by means of cooperation between the key and the cylindrical insulative housing.

2. The auto tripping key switch as set forth in claim 1, wherein the bi-metallic strip is made by joining two or more than two metallic sheets having different coefficients of thermal expansion such that the bi-metallic strip deforms upon temperature increment and returns to a normal state when the bimetallic strip cools down.

3. The auto tripping key switch as set forth in claim 1, wherein the bi-metallic strip is formed by stamping subjecting the bi-metallic strip to resiliently urge towards the cylindrical insulative housing.

4. The auto tripping key switch as set forth in claim 1, further comprising a resilient body having a first end that is fastened to the switch housing and a second end that is in contact with the bi-metallic strip subjecting the bimetallic strip to exert force towards the cylindrical insulative housing.

5. The auto tripping key switch as set forth in claim 4, wherein the resilient body is an arcuate spring that is formed with a slit through which the bi-metallic strip inserts.

6. The auto tripping key switch as set forth in claim 1, wherein the resilient member is a helical spring, and the cylindrical insulative housing has an open end in which is provided with a washer for contacting the helical spring, the washer being provided with a post for guiding the helical spring.

7. The auto tripping key switch as set forth in claim 1, wherein the guide grooves are in linear configuration.

8. The auto tripping key switch as set forth in claim 1, wherein the slideway includes two beveled semi-circular step faces, the two semi-circular step faces being provided with two recesses at where the two step faces meet.

9. The auto tripping key switch as set forth in claim 1, wherein the first and the second contact strips are rectangular strips being bent and each having an end that is exposed out side of the switch housing so as to be connected to electrical leads.

10. The auto tripping key switch as set forth in claim 1, wherein the cylindrical insulative housing further includes a shrunken neck and the second contact strip is formed with a recess that subjects the second contact strip to be engageable over the shrunken neck of the cylindrical insulative housing.

* * * * *